US005314365A

United States Patent [19]

Chen

[11] Patent Number: 5,314,365

[45] Date of Patent: May 24, 1994

[54] TURNTABLE STRUCTURE FOR A MOVING WOODEN HORSE TOY

[76] Inventor: Da-Hsuan Chen, P.O. Box 96-405, Taipei 10098, Taiwan

[21] Appl. No.: 51,151

[22] Filed: Apr. 22, 1993

[51] Int. Cl.[5] ..... A63H 33/26; A63H 3/28

[52] U.S. Cl. ..... 446/133; 446/299; 40/411; 84/95.1; 472/29

[58] Field of Search ..... 446/133, 134, 136, 137, 446/139, 297, 298, 299, 302; 40/411, 414, 455; 472/9, 11, 29, 35; 84/94.1, 94.2, 95.1, 95.2

[56] References Cited

U.S. PATENT DOCUMENTS

| | | | |
|---|---|---|---|
| 2,323,837 | 7/1943 | Neal | 446/131 X |
| 3,012,369 | 12/1961 | West | 446/133 |
| 3,318,043 | 5/1967 | Abbott | 446/133 |
| 4,233,777 | 11/1980 | Inoue | 446/133 X |
| 4,545,775 | 10/1985 | Kim | 446/299 |
| 4,573,939 | 3/1986 | Hoshino | 446/298 |

FOREIGN PATENT DOCUMENTS

| | | | |
|---|---|---|---|
| 370946 | 9/1963 | Switzerland | 84/94.2 |
| 19276 | of 1907 | United Kingdom | 472/29 |

*Primary Examiner*—Danton D. DeMille
*Assistant Examiner*—D. Neal Muir

[57] ABSTRACT

An improved turntable structure for a moving wooden horse toy, which comprises a rotation structure mounted between a turntable and a base disk; the rotation structure includes a round niche under the turntable, and a music box assembly mounted in the round niche; the center of the music box is connected with the supporting shaft in the center of the bearing base on the base disk. Between the turntable and the base disk, there is a roller bearing assembly to provide a rotary connection between the turntable and the base disk; a vertical-driving mechanism is mounted between the edge portions of the turntable and the base disk; when the turntable is driven with the driving power of the music box, the vertical-moving rods mounted on the edge portion of the turntable will jump up and down simultaneously as a result of a repelling force between the upper magnets under the turntable and the lower magnets on the base disk.

3 Claims, 3 Drawing Sheets

TURNTABLE STRUCTURE FOR A MOVING WOODEN HORSE TOY

BACKGROUND OF THE INVENTION

1. Field of the Invention:

This invention relates to a turntable, and particularly to a mechanical type of music box, which provides a driving power to cause the wooden horses on the turntable to jump up and down.

2. Description of the Prior Art:

A conventional rotary wooden-horse structure, such as the Taiwan patent application No. 77208528, comprise a base member, in which a music box is mounted; the music box has a driving spring and a spindle of the spring; the outer end of the spindle is connected with a rotative rod; one end of a drum member in the music box is mounted with a gear, which is engaged with another gear mounted on another shaft. Both ends of the shaft are mounted with two eccentric cams respectively. The rotary rod passes through a hollow rod on the base member, and then is connected with a top cap. On both sides of the rotary rod, there are two jumping-horse shafts, of which the lower ends are in contact with the two eccentric cams respectively. When the music box turns, the driving spring spindle and the drum member will transmit a driving power to the gears to cause the wooden horses to move up and down, and simultaneously to cause the top cap to turn.

Another conventional rotary wooden-horse structure, such as the Taiwan patent application No. 80210021, comprises a turntable with a sleeve pipe mounted in the center thereof; the top of the sleeve pipe is fastened with a top cap, the lower end of the sleeve pipe is mounted in a center hole of a bearing, of which the outer surface is mounted with a transmission disk; the lower edge of the transmission disk is in contact with a friction wheel of the music box. The edge portion of the turntable is mounted with several vertical rods, of which each is fastened with a wooden horse. The lower end of the vertical rod is a round shaft to be engaged with a round guide rail, which is a corrugated rail. When the music box rotates, the friction wheel will drive the transmission disk to turn; the transmission disk will drive the rotary wooden horses to move up and down by means of the round shaft of the vertical rod and the round guide rail.

In the aforesaid prior art, the rotary wooden horses will move around in an up-and-down manner upon the turntable turning; however, a mechanical type of music box is unable to drive the aforesaid mechanism because of the friction resistance existing between the friction wheel and the transmission disk, and the friction resistance between the round shaft and the round guide rail; in other words, such structure has to be driven with an electro-motive type of music box.

Still another rotary wooden-horse structure, such as the Taiwan patent application No. 75211240, comprises a music box mounted in a casing; the drum member of the music box has a gear to engage with a horizontal gear, which is mounted with a center shaft; the upper end of the center shaft is fastened with a disk, on which several magnets are attached; the top of the casing is mounted with a swinging or a rotary member, of which the lower end is attached with a magnet. When the music box turns, the disk with several magnets will also turn; in that case, the swinging or rotary member over the casing will swing or turn as a result of the magnetic force between them.

The music box of the aforesaid prior art can provide a rotation force; when the disk turns, the magnets thereon and the magnet of the swinging member will have an attracting and repelling force for each other to cause an up-and-down movement; however, such a structure is unable to be used or transferred to a rotary wooden-horse structure.

SUMMARY OF THE INVENTION

This invention relates to a transmission structure for a moving wooden-horse toy, in which a mechanical type of music box is used for driving a turntable mounted with several wooden horses.

The prime object of the present invention is to provide an improved turntable structure for a moving wooden horse toy, in which a supporting rod is mounted in the center of a turntable; the upper end of the supporting rod is attached with a top cover. The edge portion of the turntable is mounted with several symmetrical vertical-moving rods, of which each is mounted with a wooden horse on the upper part thereof. All the weight on and above the turntable falls on a horse disk through a music box assembly. The driving power is to be transmitted through a transmission shaft to the base disk from the turntable, and a driving mechanism in the music box assembly; when the driving mechanism rotates, the turntable will be driven to turn, and simultaneously the vertical-moving rods on the turntable will cause the wooden horses to jump up and down.

Another object of the present invention is to provide an improved turntable structure, in which the inside of the turntable has a round niche for receiving a driving mechanism of the music box; the driving mechanism is fixedly mounted on a base plate. After the driving mechanism is fixed in place, the transmission shaft is positioned in the center of the turntable. The transmission shaft of the driving mechanism extends downwards to a bearing base in the center of the base disk. When the driving mechanism rotates, the turntable and the base disk will have relative coaxial rotation.

Still another object of the present invention is to provide an improved turntable structure, in which all the weight of the turntable parts falls on the bearing base through the transmission shaft of the driving mechanism inside the turntable. The driving mechanism is fixedly mounted on a base plate of the music box assembly. Between the base plate and the supporting disk, there are ring-shaped flanges. A roller bearing assembly is sandwiched between the base plate and the supporting disk after the turntable and the base disk being assembled together. Both the top and bottom sides of the roller bearing assembly are covered with an upper and lower metal washers respectively. The outer edge portions of the two metal washers are supported with the base plate of the music box assembly and the supporting disk of the bearing base respectively. The roller bearing assembly is used for carrying all the weight on the turntable, and for smoothing the rotation of the turntable.

A further object of the present invention is to provide an improved turntable structure, in which the driving mechanism provides the turntable with a driving power source by means of the music box, which includes a driving spring and a shaft thereof, and both of them are deemed an input and an output means as well. The transmission shaft of the turntable and the supporting shaft of the bearing base are connected together by means of screw threads. When the driving spring releases a rotation power through the transmission shaft, the base disk on a table surface becomes a still member, while the turntable becomes a rotary member around the supporting shaft as a center.

A still further object of the present invention is to provide an improved turntable structure, in which each vertical-moving rod passes through the turntable and extends into the hollow cylindrical chamber under the turntable, being fastened with a magnet by using a screw. The top surface of the base disk furnished with several magnet holes for receiving several lower magnets respectively. When the turntable is rotated, the upper magnet and the lower magnet will generate a repelling force upon being coincided to cause the vertical-moving rod to jump up; as soon as the repelling force is removed, the vertical-moving rod will fall down as a result of the weight thereof; simultaneously, the wooden horses mounted on the vertical-moving rods look as if to jump up and down.

The major feature of the present invention is that the driving power between the turntable and the base disk is furnished completely from the input terminal of the driving mechanism, i.e., the turntable is driven to turn by using a force released out of the driving spring directly without requiring additional transmission parts; therefore, the friction wear and tear between the parts will become minimum. All the weight on the turntable will fall on the roller bearing assembly in the center, i.e., the rotation is steady and smooth, since the rolling friction resistance is minimum; therefore, the turntable can be driven to rotate by using a mechanical type of music box according to the present invention.

DETAILED DESCRIPTION OF THE PREFERRED EMBODIMENT

Figure 1:
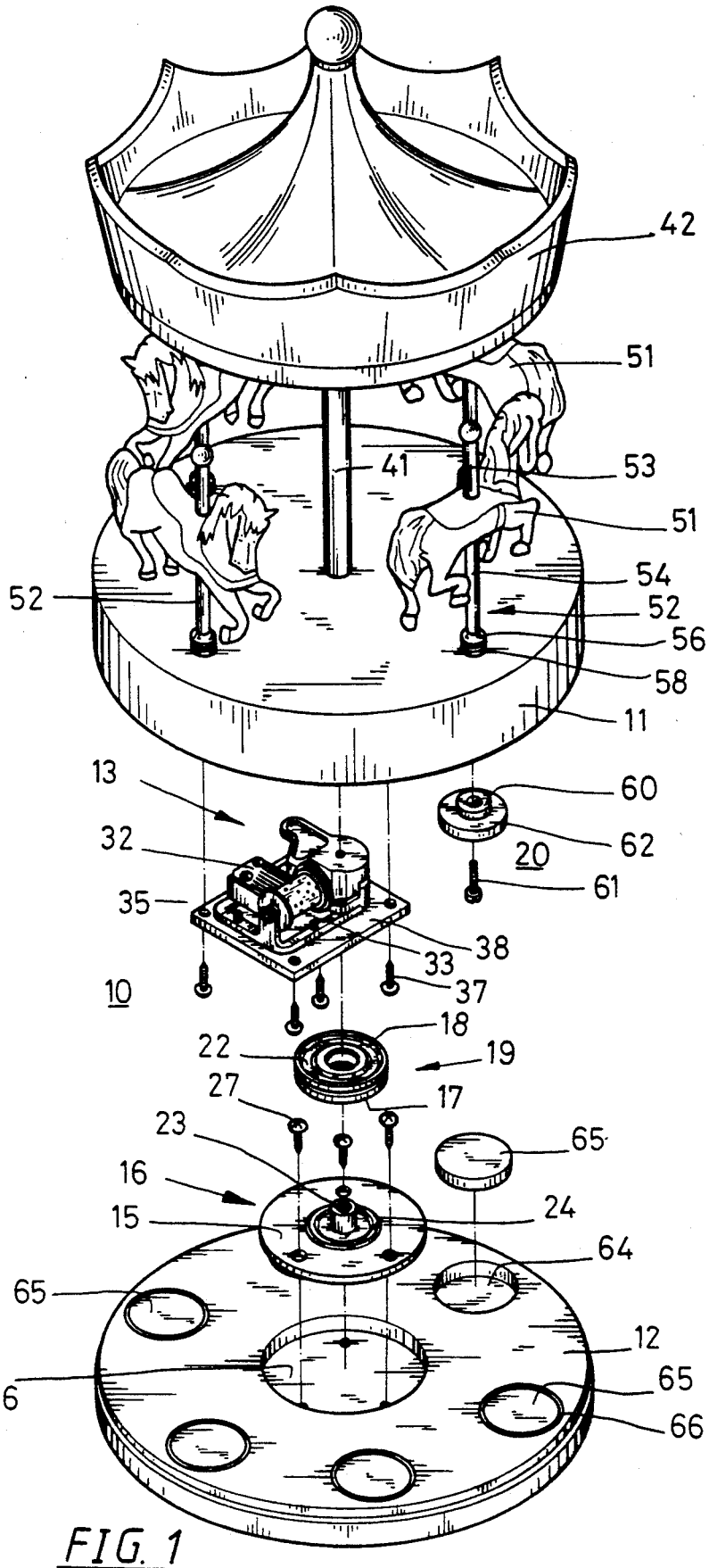
FIG. 1 is a disassembled view of an embodiment according to the present invention.
Figure 2:
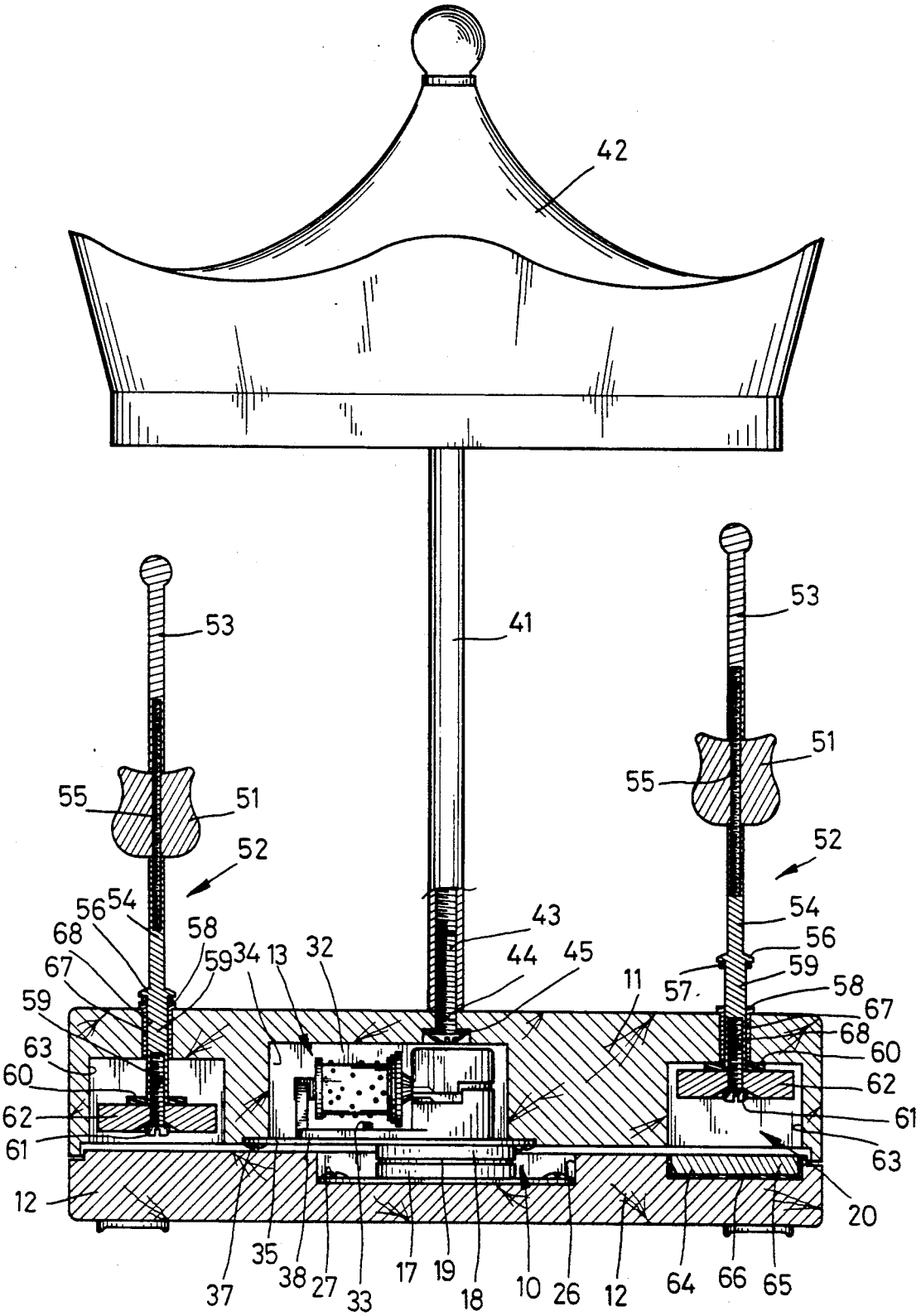
FIG. 2 is a sectional view of the present invention.
Figure 3:
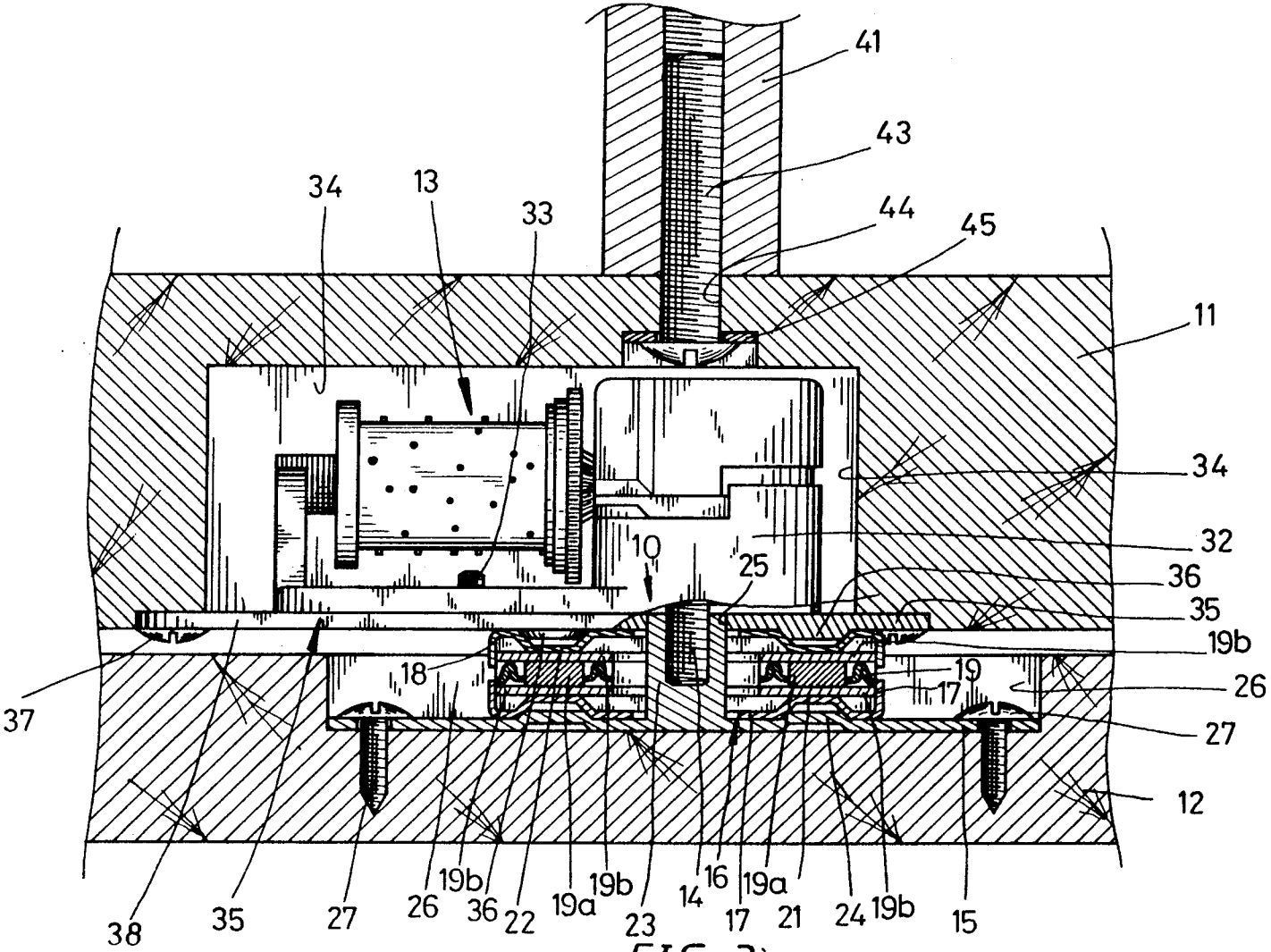
FIG. 3 is an enlarged section view of the base disk and the turntable according to the present invention.

Referring to FIGS. 1 to 3, the present invention is a rotation structure for a moving wooden horse toy; the rotation structure 10 including a turntable 11 and a base disk 12, which are pivotally connected together with a transmission shaft 14 through a music box 32 as a center shaft. The transmission shaft 14 is pivotally connected with a supporting shaft 23 of a bearing base 16 on the base disk 12. The base disk 12 is substantially a still member to be placed on a table surface, while the turntable 11 is a rotary member around the supporting shaft 23. Upon the turntable 11 turning, a plurality of wooden horses 51 on the outer edge of the turntable 11 will jump up and down.

The rotation structure 10 between the turntable 11 and the base disk 12 as shown in FIGS. 1 to 3 is mounted in a music-box chamber 34 under the center of the turntable 11. The rotation structure 10 includes a driving mechanism 13, which is a mechanical type of music box 32 fixedly mounted with a base plate 38; the transmission shaft 14 of the music box 32 is put through a round hole 25 of the base plate. After the transmission shaft 14 is fixed, through the base plate 38, under the turntable 11, the transmission shaft 14 is right in the center of the turntable 11. The rotation structure 10 is mounted in a round niche 26 in the center of the base disk 12; in the round niche 26, a supporting disk 15 of the bearing base 16 is fixedly mounted. The supporting shaft 23 of the bearing base 16 is mounted in the center of the base disk 12. The bearing base 16 has a ring-shape flange 24 around the supporting shaft 23; the ring-shape flange 24 is used for positioning a lower metal washer 17 outside and under a roller bearing 19. After the roller bearing 19 is mounted on the bearing base 16, the supporting shaft 23 of the bearing base 16 will be engaged with the transmission shaft 14 of the music box 32. All the weight above the turntable will fall to the roller bearing 19.

The bottom of the turntable 11 has a music-box chamber 34 with a screw bolt hole 44 for receiving a screw bolt 43, which is mounted with a washer 45. The upper portion of the screw bolt 43 is engaged in a supporting rod 41. The top of the supporting rod 41 is mounted with a top cover 42. The music-box chamber 34 is used for accommodating the music box 32, which is fixedly mounted, with several screws 33, on a base plate 38; the base plate 38 is then mounted on the edge of the music-box chamber 34 in the turntable 11 with several screws 37 so as to place the music box 32 in the music-box chamber 34. After the music box 32 is fixed on the base plate 38, the transmission shaft 14 will pass through the round hole 25 of the base plate 38. Upon the base plate 38 being mounted in the music-box chamber 34 under the turntable 11, the round hole 25 will be put under the center of the turntable 11. The turntable 11 and the base disk 12 are assembled together by means of the transmission shaft 14 of the music box 32 and the supporting shaft 23 of the bearing base 16. There is a music box assembly 35 mounted around the transmission shaft 14, and the music box assembly 35 is mounted on the base plate 38, which has a ring-shape flange 36 under the bottom thereof; the ring-shape flange 36 is used for positioning an upper metal washer 18 of the roller bearing assembly 19.

The base disk 12 under the turntable 11 has a round niche 26 for receiving a bearing base 16 to be fixed in place with several screws 27. The bearing base 16 includes a supporting disk 15 and a supporting shaft 23; the top side of the supporting disk 15 has a ring-shape flange 24, which is used for positioning a lower metal washer 17 under the roller bearing assembly 19 upon the same being mounted on the bearing base 16. When the bearing base 16 is placed in the round niche 26, the supporting shaft 23 of the bearing base 16 will be placed in the center of the base disk 12.

The rotation structure 10 mounted between the turntable 11 and the base disk 12 is assembled together by using the supporting shaft 23 of the bearing base 16 on the base disk 12 and the transmission shaft 14 of the music box 32 under the turntable 11. The supporting force of the supporting shaft 23 and the transmission shaft 14 is deemed insufficient to support the weight of the turntable 11 and the parts above; therefore, the roller bearing assembly 19 is mounted between the bearing base 16 of the base disk 12 and the base plate 38 of the turntable 11; the roller bearing assembly 19 is sandwiched between the lower and the upper metal washers 17 and 18; the roller bodies **19*a* are sandwiched between two roller covering plates 19*b*, which have a bottom and a top roller contact surfaces 21 and 22 respectively. The top and the bottom of the roller contact surfaces 22 and 21 are in contact with two ring-shape flanges 36 and 24** respectively so as to have the roller bearing assembly 19 surely positioned between the turntable 11 and the base disk 12.

After the rotation structure is assembled and mounted between the turntable 11 and the base disk 12, the bearing base 16 will be fixedly mounted in the round niche 26 in the base disk 12; then, the supporting shaft 23 of bearing base 16 will be put in the center of the base disk 12. The music box 32 is first fixedly mounted on the base plate 38 before being put in the music-box chamber 34 of the turntable 11. When the base plate 38 is fixed in place, the transmission shaft 14 of the music box 32 will be located in the center under the turntable 11. Between the bearing base 16 and the music box assembly 35, there is a roller bearing assembly 19 to support the weight of the turntable 11. The roller bearing assembly 19 includes a lower and an upper metal washers 17 and 18 to sandwich the roller bearing; the roller bearing is placed over the ring-shape flange 24 on the outer part of the bearing base 16; the ring-shape flange 24 and the lower metal washer 17 can provide a positioning function. After roller bearing assembly 19 is mounted on the bearing base 16 of the base disk 12, the turntable 11 will be mounted on the supporting shaft 23 by using the transmission shaft 14 so as to have the turntable 11 and the base disk 12 assembled together; then, the power transmission between the turntable 11 and the base disk 12 is merely relied upon the transmission shaft 14 and the supporting shaft 23; i.e., to transmit the winding and un-winding power of the driving spring in the music box 32. The weight of the turntable 11 is supported with the roller bearing assembly 19. Both the top and bottom sides of the roller bearing assembly 19 are covered with the top roller contact surface 22 and the bottom roller contact surface 21 respectively of the upper and the lower metal washers 18 and 17. The outer edges of the metal washers 18 and 17 are in close contact with the base plate 38 and the bearing base 16 of the ring-shape flanges 36 and 24 respectively. Upon the turntable 11 turning, the music box assembly 35 and the bearing base 16 will support the weight of the parts mounted above the turntable 11; the roller bearing assembly 19 can reduce the friction resistance of the rotary parts.

The supporting shaft of rotation structure 10 is used for connecting and supporting the weight of the turntable 11 and other parts during rotating between the turntable 11 and the base disk 12. The rotation power of the rotation structure 10 is furnished by the transmission shaft 14 of the music box 32. The transmission shaft 14 is fixed in the supporting shaft 23 of the base disk 12. The rotation power is to be produced by pushing the outer surface of the turntable 11 with a user's hands so as to wind the driving spring in the music box 32; then, the user's hands are removed from the turntable 11 to have the driving spring unwound; in that case, the music box 32 will produce a pleasant music sound, and the turntable 11 will turn, while the base disk 12 is in a still state.

The rotation structure 10 is used for assembling the turntable 11 and the base disk 12 together to provide a smooth rotation function. The edge portions of the turntable 11 and the base disk 12 are provided with a plurality of vertical-driving mechanism 20 to cause a plurality of wooden horses 51 to jump up and down. When the vertical-driving mechanism 20 are driven by the music box 32 to move, a plurality of vertical-moving rods 52 will move up and down simultaneously. Each of the vertical-moving rods 52 as shown in FIGS. 1 to 3 includes an upper rod 53, a connecting screw bolt 55, a wooden horse 51 and a lower rod 54. The edge portion of the turntable 11 have a plurality of inner holes 67, of which each is mounted with a bushing 58 with a bushing screw hole 68 for receiving the lower rod 54. The guide section 59 of the lower rod 54 can move up and down in the bushing screw hole 68; the vertical-moving rod 52 can move up and down upon the turntable 11 turning; therefore, a hollow cylindrical chamber 63 is furnished under the inner hole 67, and the hollow cylindrical chamber 63 is used for receiving the lower end of the guide section 59 mounted with a upper magnet 62 and a fasten screw 61; such parts can provide a vertical movement of the wooden horse upon the turntable 11 turning.

The vertical-moving rod 52 can move up and down by means of the repelling force between two magnets and the weight of the rod 52. On the edge of the base disk 12, a plurality of magnet holes 64 corresponding to the upper magnets 62 in the turntable 11 are furnished; such magnet hole 64 is to glue a lower magnet 65 therein. When the turntable 11 turns, the vertical-moving rod 52 can move upwards upon the upper magnet 62 passing over the lower magnet 65 in the base disk 12 as a result of a repelling force between them.

The up-and-down movement of the vertical-moving rod 52 on the turntable 11 is caused by the repelling force between the two magnets. In order to limit the movement of the vertical-moving rod 52, the lower rod 54 of the vertical-moving rod 52 is provided with a guide section 59 in the screw hole 68 of the bushing 58, and a limiting ring 56. A shock-absorbing washer 57 is mounted under the limiting ring 56 to minimize shock upon the rod 52 falling down; likewise, the top of the upper magnet 62 is glued with a shock-absorbing plate 60 to minimize shock upon the rod 52 moving upwards.

Between the lower rod 54 and the upper rod 53 of the vertical-moving rod 52, a wooden horse 51 is mounted around a connecting screw bolt 55 on the top of the lower rod 54; then, the connecting screw bolt 55 is connected with the upper rod 53. The wooden horse 51 can move up and down as soon as the vertical-moving rod 52 jumps up and down.

In brief, the wooden horse toy according to the present invention can jump up and down by mounting a plurality of vertical-moving rod 52 on the edge portion of turntable 11; each of the vertical-moving rods 52 is mounted through a bushing 58 in the turntable 11; an upper magnet 62 is movably mounted in the hollow cylindrical chamber 63 in the turntable 11; when the upper magnet 62 falls right on the lower magnet 65, the upper magnet 62 will move upwards as a result of a repelling force between the two magnets; when the upper magnet 62 moves away from the lower magnet 65, i.e., the repelling force being removed; then, the wooden horse 51 will fall down as a result of the weight thereof. All the vertical-moving rods 52 are mounted with different forms of wooden horses respectively, and the lower magnet 65 in the base disk 12 are also arranged in a regular space one another. Since the vertical-moving rods 52 are moved upwards by repelling force at different position, the wooden horses 51 on the turntable 11 look as if jumping one another at different time.

According of the aforesaid description to the embodiment of the present invention, it is apparent that an effective improvement to the turntable structure of a wooden horse toy has been made in a practical and novel feature.

I claim:

1. An improved turntable structure for a moving wooden horse toy comprising a turntable, a base disk and a rotation structure; said rotation structure including:

a music box assembly which including a base plate mounted with a mechanical type music box; a transmission shaft of said music box passing through a round hole of said base plate, and an outer surface of said round hole mounted with a ring-shaped flange; said music box assembly fixed in a music box chamber under said turntable; said transmission shaft of said music box being position in a center of said turntable and being screwed together with a supporting shaft of a bearing base;

said bearing base having said supporting shaft screwed together with said transmission shaft of said music box in a center on a supporting disk; an outer surface of said supporting shaft being mounted concentric with said ring-shaped flange; said bearing base fastened with several screws in a round niche of said base disk, and said supporting shaft being put in a center of said base disk, and screwed together with said transmission shaft;

a roller bearing assembly mounted between said music box assembly and said bearing base; said roller bearing assembly including a plurality of roller bodies, of which both a top roller contact surface and a bottom roller contact surface being covered with a lower and an upper metal washers respectively; said upper metal washer positioned in place by means of a ring-shaped flange of said music box assembly, while said lower metal washer positioned in place by means of another ring-shaped flange of said bearing base.

2. An improved turntable structure for a moving wooden horse toy as claimed in claim 1, wherein said roller bearing assembly of said rotation structure is mounted between said music box assembly and said bearing base is covered with said upper and lower roller-covering plates above and under said top and bottom roller contact surfaces before being covered with said upper and lower metal washers; said metal washers having two roller contact surfaces being in close contact with said roller-covering plates; said upper metal washer having a top roller contact surface which is a recess part for positioning a ring-shaped flange of said base plate; said lower metal washer having a bottom roller contact surface with a recess part for positioning said ring-shaped flange of said bearing base.

3. A turntable structure for a moving wooden horse toy comprising a rotation structure mounted between a turntable and a base disk; said rotation structure including a music box assembly to drive said turntable to move; between said turntable and said base disk, a vertical-driving mechanism being furnished; said vertical-driving mechanism including:

several inner holes on an edge portion of said turntable, and each said inner hole mounted with a bushing; a hollow cylindrical chamber mounted under said turntable for a magnet to move up and down;

several vertical-moving rods, and an upper part of each said vertical-moving rod fastened with a wooden horse, and a lower guide section of said vertical-moving rod mounted in said bushing in each of said respecting inner holes of said turntable; a limiting ring furnished on said guide section over said bushing, and a shock-absorbing washer mounted under said limiting ring; a lower end of said guide section extending into said hollow cylindrical chamber and being attached with an upper magnet;

said upper magnet having a center hole for receiving a fastening screw to fasten said upper magnet to a lower end of said guide section; a shock-absorbing plate mounted on said upper magnet; and several magnet holes furnished on a top surface of said base disk, and each said magnet hole glued with a lower magnet each having a strong repelling force relative to said upper magnet.

* * * * *